United States Patent [19]

Chou et al.

[11] 4,104,182

[45] Aug. 1, 1978

[54] LUBRICATING OIL COMPOSITION

[75] Inventors: Kechia J. Chou, Fishkill; Walter W. Hellmuth, Hopewell Junction, both of N.Y.

[73] Assignee: Texaco Inc., New York, N.Y.

[21] Appl. No.: 796,915

[22] Filed: May 16, 1977

[51] Int. Cl.[2] ..... C10M 1/32; C10M 3/26; C10M 5/20; C10M 7/30

[52] U.S. Cl. ..... 252/51.5 A; 252/32.7 E; 252/33; 252/42.7

[58] Field of Search ..... 252/32.7 E, 51.5 A, 252/33, 42.7

[56] References Cited

U.S. PATENT DOCUMENTS

| | | | |
|---|---|---|---|
| 3,796,663 | 3/1974 | Hotten | 252/51.5 A |
| 4,010,106 | 3/1977 | Rothert | 252/32.7 E |
| 4,010,107 | 3/1977 | Rothert | 252/32.7 E |

*Primary Examiner*—Irving Vaughn

*Attorney, Agent, or Firm*—Thomas H. Whaley; Carl G. Ries; J. J. O'Loughlin

[57] ABSTRACT

A lubricating oil composition comprising a hydrocarbyl oil of lubricating viscosity, a metal-containing additive characterized by promoting the formation of hard deposits in an internal combustion engine, and a hydrocarbon-substituted succinimide represented by the formula:

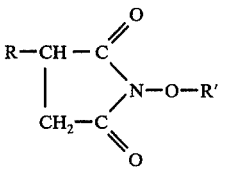

in which R is an aliphatic hydrocarbon radical having from about 1 to 50 carbon atoms and R' is a hydrocarbon radical having from 3 to 20 carbon atoms, and a method for lubricating an internal combustion engine.

16 Claims, No Drawings

LUBRICATING OIL COMPOSITION

BACKGROUND OF THE INVENTION

1. Field of the Invention

This invention lies in the field of art relating to a lubricating oil composition adapted for use between a plurality of moving surfaces with which the fluid composition is in contact for the purpose of reducing the friction between these surfaces and to provide protection from wear and corrosion. These lubricant compositions tend to deteriorate under conditions of use with the attendant formation of sludge, lacquer and carbonaceous or resinous materials which adhere to the engine parts, particularly the piston rings, grooves and skirts, and cylinder walls thus reducing the operating efficiency of the engine. To counteract the formation of these deposits, and/or to ameliorate the effects of such deposits, certain chemical additives have been found, which when added to a lubricating oil, have the ability to minimize the formation of the deposits or to maintain the deposits formed suspended in the oil so that the engine is kept clean and in efficient operating condition for extended periods of time. These agents are known in the art to which this invention pertains as detergents, dispersants or detergent-dispersants. Metal organic compounds are particularly useful in this respect and are exemplified by the oil-soluble zinc, calcium and barium salts of petroleum sulfonic acids, alkylated hydroxy benzoic acids, dialkyl dithiophosphoric acids and the like.

There are drawbacks associated with the use of organic metal salts in a lubricating oil composition for an internal combustion engine. A major drawback is that the metal salts formed by neutralization of the acids resulting from the combustion process are generally insoluble in the lubricating oil composition. More importantly, these insoluble metal salts occur as hard deposits on the piston rings, piston skirts or the cylinder liners and in the ring grooves of the engine. These hard deposits are believed to be a major contributor to the wear that is experienced in an internal combustion engine. This problem is particularly acute with compression ignition engines, such as diesel engines, wherein the engine oil is subjected to extremely high temperature and compression stresses.

This invention also pertains to a method for lubricating an internal combustion engine which comprises supplying to the lubricating system of said engine the novel lubricating oil composition described hereinabove.

The novel lubricant and method of lubricating of this invention is most efficacious when employed in a compression ignition engine, such as a diesel engine, wherein the lubricating oil composition is subjected to extreme temperature and compression stresses including engine oil temperatures above about 600° F which conditions are particularly prone to promote the formation of hard engine deposits.

2. Description of the Prior Art

The use of metal organic salts in a crankcase engine oil is disclosed in U.S. Pat. Nos. 3,528,917, 3,761,414, 3,969,235, 3,474,035 and 3,706,632. These disclosures are incorporated in the disclosure of this application.

U.S. Pat. No. 3,796,663 discloses a lubricating oil composition containing an N-hydroxy hydrocarbyl-substituted cyclic imide of a $C_4$–$C_5$ dicarboxylic acid which is a multi-functional additive designed to inhibit rust, reduce wear and control friction on metallic surfaces.

SUMMARY OF THE INVENTION

The lubricating oil composition of the invention comprises a hydrocarbon oil of lubricating viscosity and a metal-containing additive characterized by promoting the formation of hard deposits in an internal combustion engine and an effective deposit softening amount of a hydrocarbon-substituted succinimide represented by the formula:

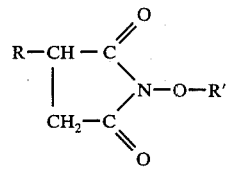

in which R is a hydrocarbon radical having from 1 to 50 carbon atoms and R′ is a hydrocarbon radical having from 3 to 20 carbon atoms. The hydrocarbon radical represented by R′ can be an aliphatic, aromatic or a mixed aliphatic-aromatic hydrocarbon radical.

In a preferred aspect of the invention the hydrocarbon-substituted succinimide component is one in which R is a monovalent hydrocarbon radical having from 6 to 30 carbon atoms and R′ is a monovalent aliphatic hydrocarbon radical having from 4 to 12 carbon atoms.

In a more preferred aspect of the invention, the hydrocarbon substituted succinimide is one in which R is a monovalent aliphatic hydrocarbon radical having from 9 to 20 carbon atoms and R′ is a monovalent aliphatic hydrocarbon radical having from 4 to 12 carbon atoms.

Generally, the carbon linked monovalent aliphatic hydrocarbon radical in the prescribed succinimide will be an alkyl or an alkenyl radical, the hydrocarbon radical having been derived from petroleum and its nature being dependent to a large extent on the reaction by which the hydrocarbon-substituted succinimide is prepared. This is a conventional reaction and involves the addition of an olefin to maleic acid or anhydride in which case the double bond in the maleic acid or anhydride becomes saturated leaving in the hydrocarbon represented by R at least one olefinic double bond. This olefinic bond can be saturated by hydrogenation according to conventional methods.

DETAILED EMBODIMENTS OF THE INVENTION

The hydrocarbon-substituted succinimide described hereinabove which is effective for softening the deposits formed in the combustion zone of an internal combustion engine can be readily prepared from an N-hydroxy-hydrocarbon-substituted succinimide. The preparation of the N-hydroxy-hydrocarbon-substituted succinimide precursor has been described in U.S. Pat. No. 3,796,663.

In the preparation of the additive of the invention, an N-hydroxy hydrocarbon-substituted succinimide is reacted with an aliphatic halide, conveniently an aliphatic chloride or bromide, in the presence of an organic base or a hydrogen halide acceptor in a suitable solvent for the reactants. This reaction proceeds at room temperature with the formation of the hydrogen halide salts and the prescribed N-alkoxy-hydrocarbon-substituted succinimide. The solvent is removed from the reaction product preferably under vacuo and the reaction product is washed with water until the prescribed succinimide is washed free of the salts. The method of preparing an N—$C_3$—$C_{20}$ hydrocarbyloxy hydrocarbon-substituted succinimide is not part of the present claimed invention.

The following examples illustrate the preparation of the deposits modifier or softener for the lubricant of this invention. Yields are in weight percent based on the N-hydroxy hydroxysuccinimide reactant.

EXAMPLE 1

0.14 mole of butyl bromide and 0.14 mole of N-hydroxy dodecenylsuccinimide are dissolved in 100 milliliters of dimethylformamide. 50 milliliters of triethylamine are added and the mixture is stirred overnight at room temperature. The solvent is then removed under vacuum and the reaction product is water washed until salt free and then dried. A yield of 85% of N-butoxy dodecenylsuccinimide is recovered.

EXAMPLE 2

0.14 mole of propyl bromide and 0.14 mole of N-hydroxy dodecenylsuccinimide are dissolved in 100 milliliters of dimethylformamide. 50 milliliters of triethylamine are added and the mixture is stirred overnight at room temperature. The solvent is then removed under vacuum and the reaction product is water washed until salt free and then dried. A substantial yield of N-propoxy dodecenylsuccinimide is recovered.

EXAMPLE 3

0.14 mole of pentyl bromide and 0.14 mole of N-hydroxy dodenylsuccinimide are dissolved in 100 milliliters of dimethylformamide. 50 milliliters of triethylamine are added and the mixture is stirred overnight at room temperature. The solvent is then removed under vacuum and the reaction product is water washed until salt free and then dried. A yield of 85% of N-pentoxy docenylsuccinimide is recovered.

EXAMPLE 4

0.14 mole of hexyl bromide and 0.14 mole of N-hydroxy octadecenylsuccinimide are dissolved in 100 milliliters of dimethylformamide. 50 milliliters of triethylamine are added and the mixture is stirred overnight at room temperature. The solvent is then removed under vacuum and the reaction product is water washed until salt free and then dried. A substantial yield of N-hexoxyoctadecenylsuccinimide is recovered.

EXAMPLE 5

0.14 mole of triphenylchloromethane and 0.14 mole of N-hydroxy tetrapropenylsuccinimide are dissolved in 100 milliliters of dimethylformamide. 50 milliliters of triethylamine are added and the mixture is stirred overnight at room temperature. The solvent is then removed under vacuum and the reaction product is water washed until salt free and then dried. A yield of 90% of N-trityloxy tetrapropenylsuccinimide is recovered.

The lubricant composition of the invention employs as its base a petroleum or mineral oil of lubricating viscosity. The base oil may consists of a paraffinic base, a naphthenic base or a mixed paraffinic-naphthenic base oil. In general, the mineral oil base will have a viscosity at 100° F ranging from about 50 to 1000 with the preferred range being from 70 to 300.

An essential feature of the lubricant of the invention is the presence of an organic metal-containing lubricant additive which under the conditions of use promotes the formation of hard deposits in an internal combustion engine. The most harmful lubricating oil additives in this respect are the organic zinc compounds, such as the zinc hydrocarbyl dithiophosphates.

Other conventional organic metal-containing lubricating oil additives which may promote hard deposits in an internal combustion engine include calcium or magnesium-containing phenolates or sulfonates.

The improvement of reducing deposits hardness caused by a lubricating oil composition was demonstrated in a bench test and in an engine test in which the hardness of the deposits produced was measured against comparison lubricants. Hardness is reported as the Knoop Hardness Number, the higher numbers indicating increasingly harder deposits.

A Base Oil employed in the examples was a blend of paraffinic mineral oils having the following inspection tests.

| | |
|---|---|
| Gravity ° API | 27.2 |
| Viscosity, SUS at | |
| 100° F | 183.3 |
| 210° F | 15.18 |

This Base Oil was blended with a conventional organic metal containing additive to form the following blend, parts given in weight percent.

| BASE BLEND A | |
|---|---|
| Base Oil, % | 99.0 |
| Zinc dialkyldithiophosphate[1] | 1.0 |

[1] Prepared by reacting 2.7 moles of an alcohol mixture (consisting of 70% heptanols, 10% hexanols, 10% octanols and 10% butanols and minor components), 2.3 moles of isopropanol and 1.0 mole $P_2S_5$ in a conventional manner and then reacting the dialkyldithiophosphonic acid with an excess of zinc oxide to form the zinc dialkyldithiophosphate.

Base Blend B was a conventional diesel engine oil. It contained a calcium carbonate overbased (300 TBN, Total Base Number) calcium sulfonate, an overbased (5 TBN) calcium sulphonate, a 2/1 overbased sulfurized calcium alkylphenolate, a zinc dialkyldithiophosphate and a zinc diaryldithiophosphate in addition to a conventional dispersant, rust inhibitor and foam inhibitor. Its inspection values were as follows:

| | |
|---|---|
| Gravity, API | 25.2 |
| Viscosity, SUS at | |
| 100° F | 137.0 |
| 210° F | 12.76 |
| % Phosphorus | 0.17 |
| % Calcium | 0.24 |
| % Zinc | 0.10 |

The oil compositions of the invention as well as comparison oils were employed under deposit forming conditions in a bench test and in an engine test in order to evaluate the effectiveness of the lubricating oil composition of the invention. In the bench test, a burner nozzle was positioned midway inside of a 6 inch heat shielded well which rested on a hot plate as a source of heat. An aluminum panel was placed at the bottom of the well 3 inches below the vertically positioned, downwardly directed nozzle. The temperature of the aluminum panel was controlled by a thermocouple.

In operation, the temperature of the aluminum panel was maintained at 675° F. The test oil was passed through the nozzle at a rate of 8 liters per minute in conjunctions with an air jet. This test was run for a period of 2 hours. On completion of this high temperature oil oxidation run, the aluminum panel with the adhering oil deposits was cooled. The deposits formed were removed from the panel and their hardness determined.

In the engine test, a Caterpillar-1-G engine was used with the test oil employed as the crankcase lubricant for this engine. This engine was operated under standard operating conditions for a period of 180 hours. On completion of the running time, the engine was dissembled and the deposits formed were removed from the piston rings, grooves and skirts and from the cylinder walls and their hardness determined.

The effectiveness of the deposit softening additive of the invention was determined by adding same to the foregoing Base Blends and comparing the results in the above described Bench and Caterpillar Engine Tests. The results are given in Table I below.

TABLE I

LUBRICANT COMPOSITION

| Run | Additive Concentration; | wt % | Knoop Hardness Number: Bench Test | Knoop Hardness Number: Caterpillar 1-G Engine Test |
|---|---|---|---|---|
| 1. | Blend A + N-hydroxydodecenyl succinimide | 2 | 227–268 | — |
| 2. | Blend A + N-butoxydodecenyl succinimide | 2 | 194–227 | — |
| 3. | Blend B — | — | 268–755 | 268–355 |
| 4. | Blend B + N-butoxydodecenyl succinimide | 2 | 155–194 | 155–194 |
| 5. | Blend B + N-trityloxytetrapropenylsuccinimide | 2 | 155–194 | — |

(a) Knoop Hardness Numbers were determined by direct comparison to standard specimens of known hardness.

Both the Bench Test and the Engine Test demonstrate that there was a substantial reduction in the hardness of the deposits formed when the lubricating oil composition of the invention was employed in these tests. This discovery was unexpected and it provides a novel solution to the problem of reducing or ameliorating engine wear in an internal combustion engine.

We claim:

1. A lubricating oil composition comprising a major portion of a hydrocarbon oil of lubricating viscosity, a minor amount of a metal-containing additive characterized by promoting the formation of hard deposits in an internal combustion engine and an effective deposit softening amount of a hydrocarbon-substituted N-hydrocarbyloxy succinimide represented by the formula:

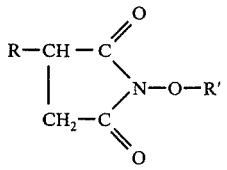

in which R is a hydrocarbon radical having from 1 to 50 carbon atoms and R′ is a hydrocarbon radical having from 3 to 20 carbon atoms.

2. A lubricating oil composition according to claim 1 in which R is a hydrocarbon radical having from 6 to 30 carbon atoms and R′ is a hydrocarbon radical having from 4 to 12 carbon atoms.

3. A lubricating oil composition according to claim 1 in which R is a hydrocarbon radical having from 9 to 20 carbon atoms and R′ is a hydrocarbon radical having from 4 to 12 carbon atoms.

4. A lubricating oil composition according to claim 1 containing from about 0.1 to 5 weight percent of said succinimide.

5. A lubricating oil composition according to claim 1 in which said succinimide is N-butoxydodecenyl succinimide.

6. A lubricating oil composition according to claim 1 in which said succinimide is N-propoxydodecenyl succinimide.

7. A lubricating oil composition according to claim 1 in which said succinimide is N-pentoxy dodecenyl succinimide.

8. A lubricating oil composition according to claim 1 in which said succinimide is N-triphenylmethoxy dodecenylsuccinimide.

9. A lubricating oil composition according to claim 1 in which said succinimide is N-octoxydecenylsuccinimide.

10. A lubricating oil composition according to claim 1 in which said succinimide is N-dodecyloxydodecenyl succinimide.

11. A method for lubricating an internal combustion engine which comprises supplying to the crankcase and lubricating system of said engine a lubricating oil composition comprising a major portion of a hydrocarbon oil of lubricating viscosity, a minor amount of a metal-containing additive characterized by promoting the formation of hard deposits in an internal combustion engine, and an effective deposit softening amount of a hydrocarbon-substituted N-hydrocarbyloxy succinimide represented by the formula:

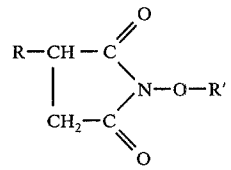

in which R is a hydrocarbon radical having from 1 to 50 carbon atoms and R′ is a hydrocarbon radical having from 3 to 20 carbon atoms.

12. A method according to claim 11, in which R is a hydrocarbon radical having from 6 to 30 carbon atoms and R′ is a hydrocarbon radical having from 4 to 12 carbon atoms.

13. A method according to claim 11 in which R is a hydrocarbon radical having from 9 to 20 carbon atoms and R′ is a hydrocarbon radical having from 4 to 12 carbon atoms.

14. A method according to claim 11 in which said succinimide is N-butoxydodecenyl succinimide.

15. A method according to claim 11 in which said succinimide is N-propoxydodecenyl succinimide.

16. A method according to claim 11 in which said succinimide is N-triphenylmethoxy-dodecenyl succinimide.

* * * * *